United States Patent [19]

Gaffney

[11] 4,227,864

[45] Oct. 14, 1980

[54] PUMP FOR LIQUIDS

[75] Inventor: Edward N. Gaffney, West Midlands, England

[73] Assignee: Lucas Industries Limited, Birmingham, England

[21] Appl. No.: 8,532

[22] Filed: Feb. 1, 1979

[30] Foreign Application Priority Data

Feb. 17, 1978 [GB] United Kingdom ..... 6327/78

[51] Int. Cl.[3] ..... F04B 1/12; F04B 27/08

[52] U.S. Cl. ..... 417/269; 91/497

[58] Field of Search ..... 417/221, 269, 460; 91/497, 493, 494, 496

[56] References Cited

U.S. PATENT DOCUMENTS

| | | | |
|---|---|---|---|
| 2,678,608 | 5/1954 | Woydt | 91/493 |
| 3,747,477 | 7/1973 | Aldinger | 91/497 |
| 4,018,138 | 4/1977 | Rumsey | 91/497 |
| 4,165,677 | 8/1979 | Tobias | 91/497 |

*Primary Examiner*—Robert W. Jenkins

*Attorney, Agent, or Firm*—Holman & Stern

[57] ABSTRACT

A pump for liquids having a rotor containing a plurality of bores each slidably receiving a piston. The pistons are coupled at one end to means constraining the pistons, when rotating with the rotor, to rotate about an axis spaced from but parallel to the axis of rotation of the rotor whereby the pistons reciprocate in their respective bores so that a pumping action occurs. The rotor is mounted on a hollow shaft for rotation about a first axis, and the outer surface of the shaft is formed with recesses which define inlet and outlet chambers communicating with bores of the rotor as the rotor rotates. A spindle is rotatable in the hollow shaft about a second axis, the second axis being parallel to but spaced from the first axis. The means constraining the pistons includes a member rotatably mounted on the spindle for rotation relative thereto about a third axis parallel to and spaced from the second axis, and the spacing between the first and third axes effecting reciprocation of the pistons as the rotor rotates, the spacing of the first and third axes determining the stroke of the pistons.

3 Claims, 3 Drawing Figures

PUMP FOR LIQUIDS

This invention relates to a pump for liquids particularly but not exclusively liquid fuel for an internal combustion engine, the pump being of the kind comprising a rotor having therein a plurality of radially extending bores each slidably receiving a piston, the pistons being coupled at their outer ends to means constraining the pistons, when rotating with the rotor, to rotate about an axis spaced from but parallel to the axis of rotation of the rotor whereby the pistons reciprocate in their respective bores so that the radially innermost ends of the pistons co-operating with liquid inlet and outlet means within the rotor effect a pumping action.

A known pump of the kind specified is disclosed in FIGS. 2 to 4 of British patent specification No. 463854. In this known pump the means constraining the pistons comprises a guide ring of large diameter encircling the rotor and in sliding engagement with the radially outer end regions of the pistons, the ring being mounted in a casing with its axis parallel to but spaced from the axis of rotation of the rotor. The arrangement is disadvantageous in two respects, firstly it is a fixed stroke arrangement and thus the displacement of the pump is fixed, and secondly the use of a large diameter guide ring in sliding engagement with a plurality of pistons entails a high rubbing speed as the rotor rotates and thus is susceptible to a high wear unless special precautions are taken, for example the use of specially hardened parts. It is an object of the present invention to provide a pump of the kind specified wherein the above mentioned disadvantages are minimised or obviated.

According to the present invention in a pump of the kind specified the rotor is mounted on a hollow shaft for rotation relative thereto about a first axis, the outer surface of said shaft being formed with recesses which, with the rotor, define inlet and outlet chambers communicating with said bores of the rotor as the rotor rotates, a spindle is rotatable in said hollow shaft about a second axis parallel to but spaced from said first axis, and said means constraining said pistons includes a member engaged with each piston for movement relative thereto in a direction transverse to the length of the piston, said member being rotatably mounted on said spindle for rotation relative thereto about a third axis parallel to and spaced from said second axis and said member being constrained to rotate with the rotor but about said third axis whereby the spacing between the first and third axes effects reciprocation of the pistons as the rotor rotates, said spacing of the first and third axes determining the stroke of the pistons and thus the displacement of the pump and being variable by rotation of the spindle about said second axis relative to said shaft.

Preferably each of said pistons includes at its radially outer end, a channel shaped shoe the channel of which extends at right angles to the length of the piston and slidably receives a respective block comprising part of said member.

Conveniently said spindle has an integral part whose axis is said third axis and upon which said member is rotatably mounted.

One example of the invention is illustrated in the accompanying drawings wherein.

Figure 1:
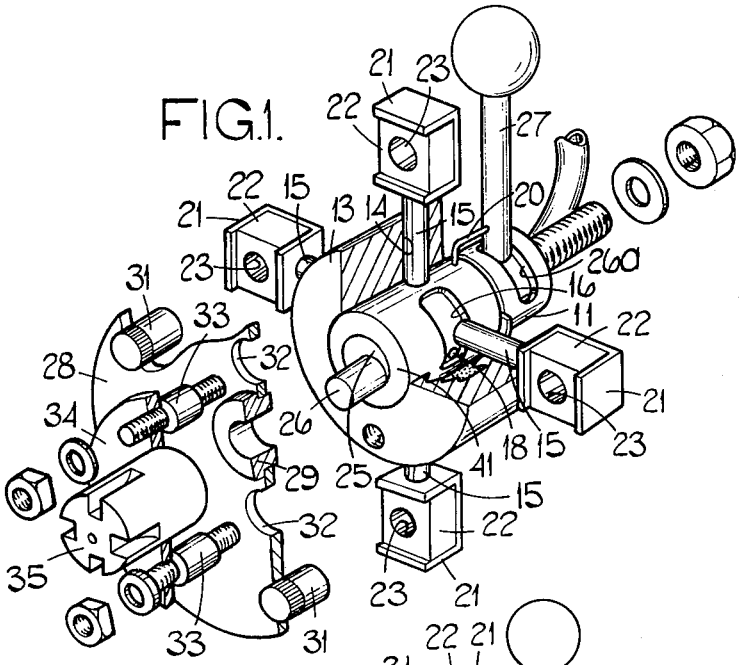
FIG. 1 is an exploded perspective view partly broken away of a pump.
Figure 2:
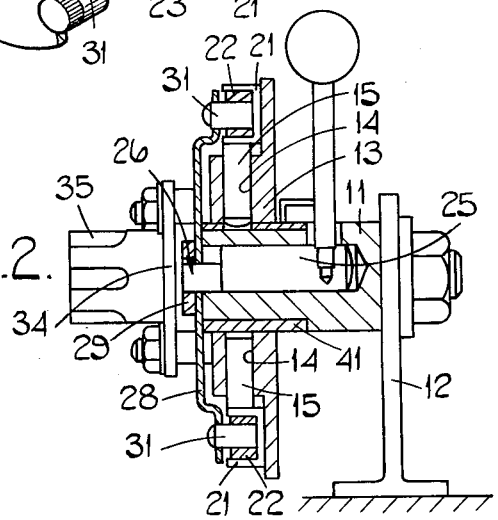
FIG. 2 is a sectional view to a reduced scale of the pump shown in FIG. 1.
Figure 3:
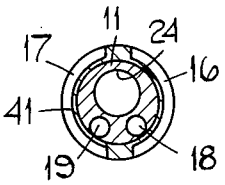
FIG. 3 is a sectional view of the shaft of the pump shown in FIGS. 1 and 2.

Referring to the drawings the pump includes a hollow cylindrical shaft 11 of circular transverse cross-section secured to a mounting bracket 12. Rotatably mounted as a close but sliding fit on the shaft 11 is a sleeve 41 and rotatable on the sleeve 41 is an annular rotor 13 having four equi-angularly spaced radially extending bores 14 therein. The bores each extend through the annular rotor and slidably receive respective pistons 15.

The sleeve 41 is formed with a pair of circumferentially elongate apertures closed by the shaft 11 and so defining recesses 16, 17 diametrically opposite one another. The region of the rotor 13 containing the bores 14 overlies the region of the sleeve containing the recesses 16, 17 so that as the rotor rotates around the shaft the bores in turn communicate with the recesses 16,17. The wall section of the hollow shaft 11 is formed with a pair of drillings, 18, 19 the drilling 18 communicating at one end with the recess 16, and communicating at its other end with a liquid outlet conduit while the drilling 19 communicates at one end with the recess 17 and communicates at its other end with a liquid inlet conduit.

At their radially outermost ends each of the pistons 15 carries a U-shaped metal shoe 21. The shoes 21 are thus of channel-shaped cross-section and are arranged with their channels extending at right angles to the length of the respective piston. Slidably received in each of the shoes 21 is a rectangular metal or graphite block 22 having a centrally disposed bore 23 the axis of which extends at right angles to both the length of the channel of the shoe 21 and at right angles to the axis of the respective piston. It will be recognised that each of the blocks 22 can be moved relative to its respective piston 15 in a direction at right angles to the axis of the piston, that is to say along the length of the channel defined by the respective shoe 21, but that during movement of each block in a direction parallel to the axis of the respective piston 15 then the piston will be moved with the block.

The bore 24 of the hollow shaft 11 is arranged eccentrically with respect to the outer surface of the shaft 11, that is to say the axis of the bore is parallel to, but spaced from the axis of the cylindrical outer surface of the shaft 11. Rotatable in the bore 24 is a spindle 25, the spindle 25 including at its end remote from the bracket 12, an integral eccentrically positioned pin 26. The pin 26 is cylindrical and has its axis parallel to, but spaced from the axis of the remainder of the spindle 25. An arcuate slot **26*a* is formed in the wall of the shaft 11 adjacent the bracket 12 and a lever 27 secured at one end to the spindle 25 extends through the slot 26*a* to facilitate rotational movement of the spindle 25 relative to the shaft 11 through an angular distance determined by the length of the slot 26*a***.

Rotatably received on the pin 26 of the spindle 25 is a metal bush 29 secured in a central aperture of a disc 28. The bush 29 thus constrains the disc 28 to rotate relative to the spindle 25 and shaft 11 about the axis of the pin 26. Adjacent its periphery the plate 28 carries four equiangularly spaced cylindrical posts 31 which extend at right angles to the plate 28 and into the bores 23 of respective blocks 22. The plate 28 is further formed with a pair of apertures 32 disposed diametrically opposite one another on opposite sides of the bush 29 respectively. Extending through the apertures 32 are respective bolts 33 whereby a drive plate 34 is connected to the rotor 13. The drive plate 34 carries a drive spigot 35 having its axis co-extensive with the rotational axis of the rotor 13, that is to say the axis of the cylindrical outer surface of the shaft 11. The apertures 32 in the plate 28 are considerably larger than the diameter of the bolts 33 to ensure that there is sufficient clearance between the bolts 33 and the plate 28 to permit the plate 28 to move transversely relative to the axis of rotation of the rotor relative to the rotor and the drive plate 34.

The blocks 22 are a close sliding fit within the shoes 21 and it will thus be recognised that when the rotor 13 is rotated by way of the drive plate 34 and drive spigot 35 through the intermediary of the bolts 33, then the pistons 15 received in the bores 14 will rotate with the rotor 13. Moreover, the shoes 21 and blocks 22 will also rotate with the rotor and the plate 28 will be constrained to rotate with the rotor by way of the posts 31. However it is clear that the rotor 13 can only rotate about the axis of the cylindrical surface of the shaft 11 and the plate 28 can only rotate about the axis of the pin 26. While the axes of rotation of the rotor 13 and the plate 28 are parallel they are also spaced apart, and thus the axis about which the pistons 15 rotate is spaced from but parallel to the axis about which the rotor 13 rotates and the pistons 15 are therefore caused to reciprocate in the bores 14. The plane containing the axes of rotation of the rotor 13 and the plate 28 is so arranged in relation to the recesses 16, 17 that as each bore 14 communicates with the recess 16 then the piston of that bore is moving radially inwardly, while as each bore 14 communicates with the recess 17 the piston 15 of that bore is moving radially outwardly. Thus a pumping action is effected whereby the radial outward movement of the piston 15 draws liquid into the bore 14 from the recess 17 and the subsequent radial inward movement of the piston 15 displaces the liquid drawn into the bore 14 into the recess 16. The liquid is of course drawn into the recess 17 by way of the drilling 19 and the inlet conduit and flows out of the recess 16 by way of the drilling 18 and the outlet conduit.

It will be recognised that the stroke performed by the pistons 15 relative to their bores 14 is determined by the displacement of the axis of rotation of the plate 28 from the axis of rotation of the rotor 13. Since the axis of rotation of the plate 28 is the axis of the pin 26 it will be recognised that the stroke performed by the pistons can be altered by rotating the spindle 25 within the bore 24 it being recalled that the axis of the pin 26 is parallel to but spaced from the axis of the bore 24 which in turn is spaced from but parallel to the axis of rotation. Adjustment of the stroke entails an alteration, relative to the shaft 11 of the bottom dead centre positions of the pistons. In order that the relationship between the b.d.c. positions of the pistons and the recesses 16,17 is not disturbed, the lever 27 is coupled by a link 20 to the sleeve 41 so that the sleeve 41, and thus the recesses 16,17 are moved angularly relative to the shaft 11 with the b.d.c. position of the pistons as the stroke of the piston is altered. It will be understood that the drillings 18,19 must be positioned so as to communicate with the recesses 16,17 respectively, throughout the whole range of movement of the sleeve 41 relative to the shaft 11.

If desired the relative spacing of the axes can be so arranged that in one angular position of the spindle 25 relative to the shaft 11 the axis of the pin 26 is co-extensive with the axis of the cylindrical surface of the shaft 11. In this situation of course the axes of rotation of the rotor 13 and the plate 28 are co-extensive and thus no reciprocation of the pistons occurs. By moving the lever 27 angularly the spindle 25 is rotated thus displacing the axis of rotation of the plate 28 progressively from the axis of rotation of the rotor 13 and increasing the stroke of the pistons 15 and thus the displacement of the pump. The provision of a zero stroke position is useful in that in this position the starting torque needed to drive the pump from rest is minimised, simplifying the design requirements of the drive motor of the pump.

It will be recognised that since the diameter of the pin 26 is relatively small then the rubbing speed at the bearing of the bush 29 on the pin 26 is low and that consequently the problem of wear is correspondingly low.

It will be understood that conveniently a casing will house the pump with the shaft 11 projecting from the casing at one end and the spigot 35 projecting from the casing at the other end. That portion of the shaft 11 which projects will be the portion carrying the lever 27 and a low pressure seal may be provided where the shaft 11 and spigot 35 project from the casing to prevent any liquid which seeps into the casing from between the rotor and the shaft 11 and between the pistons 15 and their bores 14, from being lost. Some form of drain arrangement would be provided in the casing whereby the spilled liquid draining to the lowest part of the casing would be returned to the supply. As an alternative arrangement for example, where the pump is to be used as a liquid fuel pump for an internal combustion engine then the pump may be immersed in the liquid fuel in the fuel tank associated with the engine. In such an arrangement an outer casing might not be necessary and of course unless the portion of the shaft 11 from which the lever 27 projects is to extend from the fuel tank then an alternative remote control mechanism would be provided for angularly moving the spindle 25 to alter the stroke and therefore the displacement of the pump. Similarly, unless a totally immersed drive motor is used to rotate the spigot 35 then the spigot 35 will be required to extend through a seal in the wall of the fuel tank to permit a drive connection to be made to the rotor 13.

I claim:

1. A pump, for liquids, comprising a rotor having therein a plurality of radially extending bores each slidably receiving a piston, the pistons being coupled at their outer ends to means constraining the pistons, when rotating with the rotor, to rotate about an axis spaced from but parallel to the axis of rotation of the rotor whereby the pistons reciprocate in their respective bores so that the radially innermost ends of the pistons cooperating with liquid inlet and outlet means within the rotor effect a pumping action, the rotor being mounted on a hollow shaft for rotation relative thereto about a first axis, the outer surface of said shaft being formed with recesses which, with the rotor, define inlet and outlet chambers communicating with said bores of the rotor as the rotor rotates, a spindle is rotatable in said hollow shaft about a second axis parallel to but spaced from said first axis, and said means constraining said pistons includes a member engaged with each piston for movement relative thereto in a direction transverse to the length of the piston, said member being rotatably mounted on said spindle for rotation relative thereto about a third axis parallel to and spaced from said second axis and said member being constrained to rotate with the rotor but about said third axis whereby the spacing between the first and third axes effects reciprocation of the pistons as the rotor rotates, said spacing of the first and third axes determining the stroke of the pistons and thus the displacement of the pump and being variable by rotation of the spindle about said second axis relative to said shaft.

2. A pump as claimed in claim 1 wherein each of said pistons includes at its radially outer end, a channel shaped shoe the channel of which extends at right angles to the length of the piston and slidably receives a respective block comprising part of said member.

3. A pump as claimed in claim 1 or claim 2 wherein said spindle has an integral part whose axis is said third axis and upon which said member is rotatably mounted.

* * * * *